US005603569A

United States Patent [19]

Salomon et al.

[11] Patent Number: 5,603,569

[45] Date of Patent: Feb. 18, 1997

[54] METHOD AND DEVICE FOR MORE EFFICIENTLY UTILIZING THE VOLUME OF A CONTAINER

[75] Inventors: Heinz Salomon; Börje Torstenfelt, both of Västerås, Sweden

[73] Assignee: ABB Atom AB, Västerås, Sweden

[21] Appl. No.: 347,434

[22] PCT Filed: Nov. 16, 1994

[86] PCT No.: PCT/SE94/01078

§ 371 Date: Nov. 22, 1994

§ 102(e) Date: Nov. 22, 1994

[87] PCT Pub. No.: WO95/14998

PCT Pub. Date: Jun. 1, 1995

[30] Foreign Application Priority Data

Nov. 25, 1993 [SE] Sweden ..... 9303904

[51] Int. Cl.[6] ..... B01F 15/00; G21F 5/005; G21F 5/12; G21F 9/16

[52] U.S. Cl. ..... 366/347

[58] Field of Search ..... 366/64–66, 240, 366/242–252, 255–260, 262–265, 347, 348

[56] References Cited

U.S. PATENT DOCUMENTS

| | | | |
|---|---|---|---|
| 2,692,125 | 10/1954 | Light | 366/251 |
| 3,885,587 | 5/1975 | Troope | 366/251 X |
| 4,295,745 | 10/1981 | Brunner | 366/302 |
| 4,564,469 | 1/1986 | Cochet et al. | 252/626 |
| 4,647,213 | 3/1987 | Hay, II | 366/347 X |
| 4,666,676 | 5/1987 | Nelson et al. | 366/347 X |
| 4,671,667 | 6/1987 | Augustin | 366/279 |
| 4,798,471 | 1/1989 | Laempe | 366/244 X |
| 5,246,287 | 9/1993 | Isherwood et al. | 366/65 X |

FOREIGN PATENT DOCUMENTS

| | | | |
|---|---|---|---|
| 1446648 | 6/1966 | France | 366/347 |
| 2422232 | 11/1979 | France . | |
| 2558072 | 6/1985 | France . | |
| 2648263 | 9/1978 | Germany . | |
| 2748774 | 5/1979 | Germany . | |

*Primary Examiner*—Charles E. Cooley
*Attorney, Agent, or Firm*—Watson Cole Stevens Davis, P.L.L.C.

[57] ABSTRACT

For more efficiently utilizing the volume of a container in which a mixture of first and second compounds is stirred by a stirrer within the container, the volume of the container available for the mixture during stirring is increased by temporarily extending the length of the container by providing an adapter telescoped within the container at its open upper edge. The side wall of the adapter extends outwardly of the container edge such that a wave of the mixture generated during the stirring is prevented from overflowing the edge of the container. After the stirring is completed the adapter is moved down into the container for thereby disposing of the adapter.

6 Claims, 2 Drawing Sheets

METHOD AND DEVICE FOR MORE EFFICIENTLY UTILIZING THE VOLUME OF A CONTAINER

TECHNICAL FIELD

The present invention relates to a method and a device for more efficiently utilizing the volume of a container, for example an ultimate waste disposal container, for a mixture. The mixture is stirred in the container for the purpose of mixing a first compound, for example radioactive waste, with a second compound, for example cement powder including additives, by means of a rotating stirrer which is connected to a drive means through an opening at the upper end of the container.

BACKGROUND OF THE INVENTION

Methods and devices for handling radioactive waste in different types of nuclear installations are well-known. One way of taking care of a first compound, for example radioactive waste, is to mix it by stirring it with a second compound, for example cement powder, so as to form a mixture and to allow the mixture to solidify in a container, for example an ultimate waste disposal container. The container has an edge forming an opening at one end. A stirrer is arranged in the container for stirring the mixture in the container. A drive means is connected to the stirrer through the opening of the container while the mixture is being stirred. After the mixture has been stirred, the container is sealed by a lid and the stirrer remains in the container.

The problem is that, upon rotation of the stirrer in the container, a wave is generated which results in the mixture overflowing the edge of the container. To avoid overflow, the container is only filled to a certain level below the edge. This method results in a void being created in the upper part of the container, whereby the volume of the container upon ultimate waste disposal is not utilized in full.

One method for preventing the mixture in the container from overflowing during stirring is to arrange a lid over the opening of the container. The disadvantage of this method is that the wave which is generated during rotation of the stirrer contacts, through hydrodynamic forces, to the underside of the lid and thus disturbs process of the stirring.

A further disadvantage is that the lid after having been in contact with the mixture in the container is polluted and must be cleaned or taken care of. Cleaning entails costs or may be complicated, as in the case of, for example, radioactive pollution.

It is an object of the invention to provide a method and a device in which the volume of the container is utilized more efficiently as compared with the prior art.

A further object is to prevent the mixture contained in the container from overflowing the open edge of the container.

An additional object is to dispose of the device which is polluted by the mixture.

SUMMARY OF THE INVENTION

The invention relates to a method for more efficiently utilizing the volume of a container, and to an adapter for carrying out the method. The method comprises fitting an adapter to the edge of a container which form an opening in the container. A mixture of a first compound, for example radioactive waste, mixed with a second compound, for example cement powder including additives, are stirred in the container with the aid of a stirrer. The wave which is generated during the stirring of the mixture is prevented by the adapter from overflowing the open edge of the container. The adapter may be detachable after completed stirring.

The adapter comprises a tubular part having an outer diameter corresponding to the inner diameter of the opening in the container so as to be telescoped thereon. The adapter is, for example, in the shape of a cylinder, but other shapes such as square, oval, or triangular shape are also feasible depending on the corresponding shape of the container. The tubular part has a first and a second opening wherein the first opening makes contact with the opening of the container and the second opening allows the passage of the second compound and a drive means to the stirrer in the container. Alternatively, the second opening of the tubular part is provided with a lid with a third opening for the passage of the drive means. To the second or the third opening there is connected a member for achieving ventilation to take care of dust and aerosols which arise during the stirring.

One suitable way of disposing the adapter polluted by the mixture is to move it down into the container so as to ultimately store it together with the mixture and the stirrer in the container. Such a single use of the adapter is justified by the fact that it is more costly to clean the adapter than to not reuse it. One way of moving the adapter down into the container is to lift the container against a backup tool, by means of a hydraulic lifting device, with the adapter arranged within the opening of the container, such that the adapter is pressed down by means of the tool into the container. Similarly as in the prior art, the container is then covered by a suitable lid.

An alternative method involves arranging the adapter fixed to the ventilating member. The ventilating member together with the adapter are connected to the opening of the container while stirring, whereupon the ventilating member and the adapter maybe dismantled from the container and reused with another container for another stirring operation.

In this case, the mixture in the container is a radioactive waste slurry mixed with cement powder, but the method described is also suited for other types of compounds, such as chemical waste, liquids, and paint.

BRIEF DESCRIPTION OF THE DRAWINGS

The invention will be explained in greater detail with reference to the accompanying drawings.

DESCRIPTION OF THE PREFERRED EMBODIMENTS

Figure 1:
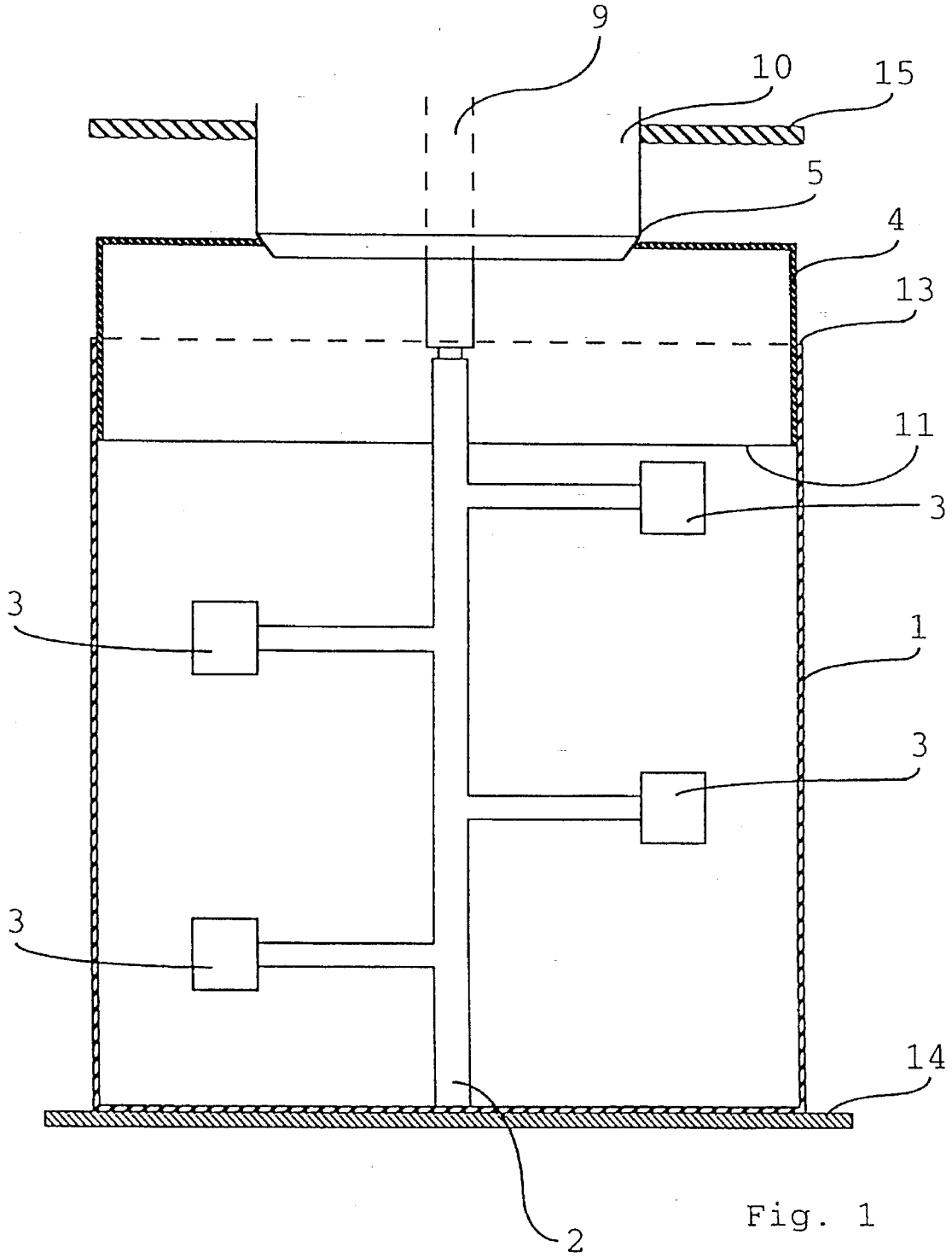
FIG. 1 shows a container having an edge forming an opening, a stirrer arranged in the container, and an adapter fitted to the opening of the container.
Figure 2:
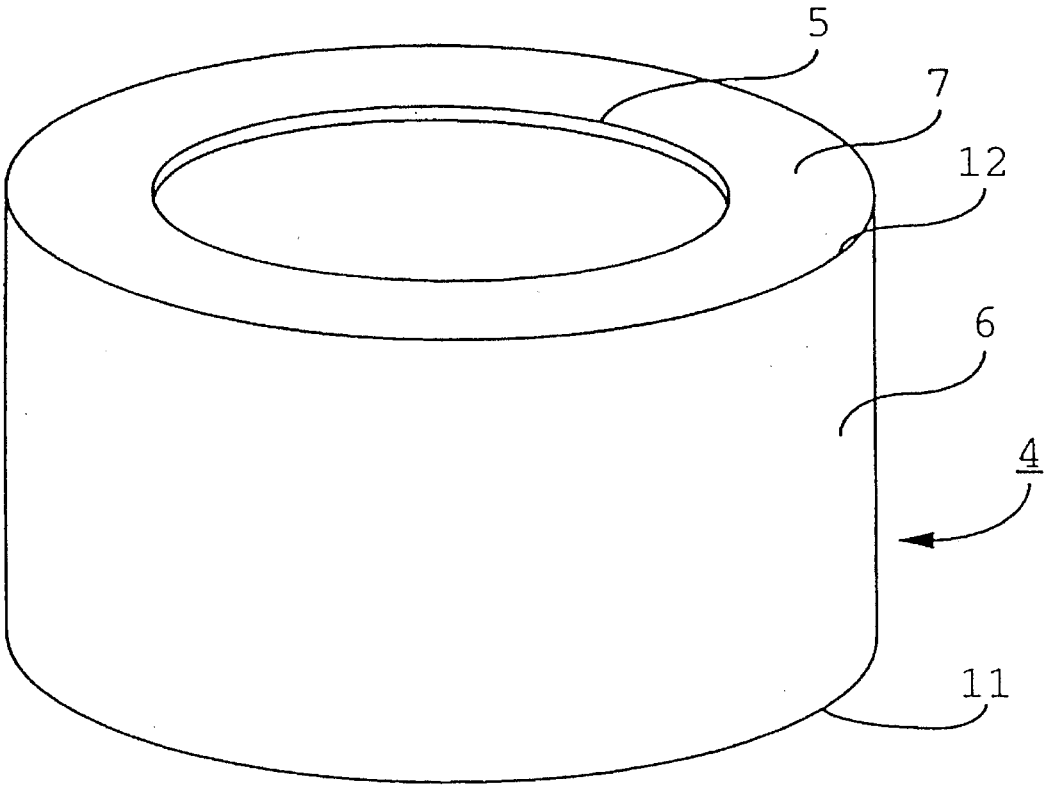
FIG. 2 shows an adapter according to the invention.

FIG. 1 shows a container 1 which has an edge 13 forming an opening of the container 1. A stirrer 2 having paddles 3 is arranged in the container 1. An adapter 4 is telescoped within the container at edge 13, as clearly shown in FIG. 1. The adapter 4 in FIG. 1 is also shown in FIG. 2. The adapter 4 comprises a tubular part 6 or sidewall with an outer diameter corresponding to the inner diameter of the container at its opening. The tubular part 6 has a first opening and a opening 11 and a second opening 12. The second opening 12 is provided with a lid 7 having a third opening 5. The stirrer 2 is connected to a drive means 9 through third opening 5 of adapter 4. A member 10, to achieve ventilation to prevent dust and aerosols which arise during the stirring from spreading to the surrounding atmosphere, is arranged around drive means 9 and over third opening 5 of the adapter 4. During rotation of the stirrer 2, a wave is generated in the mixture which is prevented by the adapter 4 from overflowing edge 13 of the container 1 as a portion of tubular part 6 extends outwardly of edge 13 for temporarily extending the length and thus the volume of the container. Since the volume of the mixture in the container 1 may be increased by the connection of the adapter 4 during the stirring, the invention results in the volume in the container 1 being utilized more efficiently. After the stirring, the adapter 4 may be moved down into the container 1 by lifting the container 1, with the adapter 4 telescoped within the container 1, by means of a hydraulic lifting device 14 against a separately placed backup tool 15 such that the adapter 4 is moved down into the container 1 by means of the tool 15.

Figure 3:
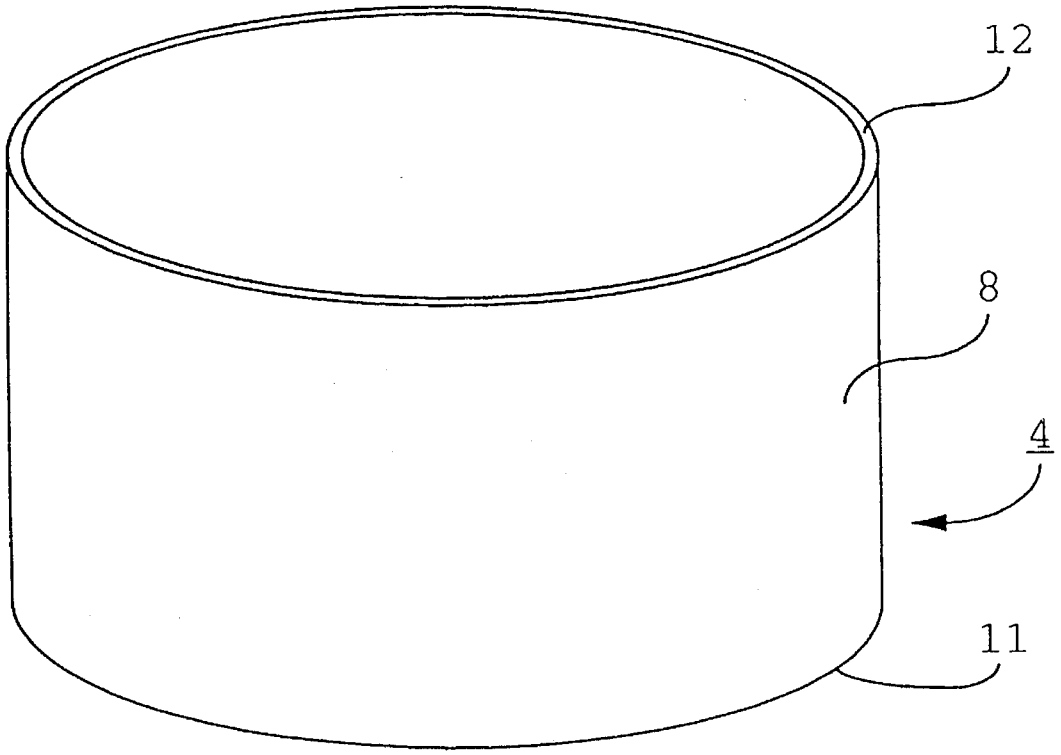
FIG. 3 shows an alternative embodiment of an adapter.

FIG. 3 shows an alternative embodiment of the adapter 4 comprising a cylinder 8 with a first and a second opening, 11 and 12, respectively. In this case, the stirrer 2 is connected to the drive means 9 through the second opening 12. The ventilating member 10 is arranged in the second opening 12.

The adapter 4 is preferably made of plastic, but also other materials are feasible, such as metal or paper.

What is claimed is:

1. A method for more efficiently utilizing the volume of a container having a given length and an edge defining an opening at an upper end thereof, a stirrer located in the container along the length thereof for stirring a mixture of first and second compounds, the method comprising the steps of increasing the volume of the container available for the mixture during stirring by temporarily extending the length of the container by providing an adapter telescoped within said container at said edge, a side wall of said adapter extending outwardly of said edge such that a wave of the mixture generated during the stirring is prevented from overflowing the edge of the container, and after the stirring is completed moving the adapter down into the container for thereby disposing of the adapter.

2. The method according to claim 1, wherein the adapter is moved down into the container by lifting the container against a backup tool.

3. The method according to claim 1, wherein a ventilation member is connected to the adapter at an opening thereof for preventing spread of dust and aerosols from the mixture.

4. The method according to claim 1, wherein after the stirring is completed, retaining the stirrer within the container before the adapter is moved down thereinto.

5. An adapter in combination with a container for more efficiently utilizing the volume of the container which has a given length and an opening at an upper end thereof, a stirrer located within the container along the length thereof for stirring a mixture of first and second compounds, the adapter being telescoped within the container and having a side wall extending in a lengthwise direction outwardly of said edge for increasing the volume of the container available for the mixture during the stirring such that a wave of the mixture generated during the stirring is prevented from overflowing the edge of the container, the adapter being movable down into the container after the stirring is completed to thereby dispose of the adapter.

6. The combination according to claim 5, further comprising a ventilation member connected to the adapter at an opening thereof for preventing spread of dust and aerosols from the container.

* * * * *